United States Patent [19]

Schenk

[11] 4,307,906

[45] Dec. 29, 1981

[54] ADJUSTABLE TOGGLE LATCH AND SAFETY CATCH

[75] Inventor: Peter Schenk, West Islip, N.Y.

[73] Assignee: Dzus Fastener Co., Inc., West Islip, N.Y.

[21] Appl. No.: 832,153

[22] Filed: Sep. 12, 1977

[51] Int. Cl.[2] ..... E05C 5/00

[52] U.S. Cl. ..... 292/247; 292/1

[58] Field of Search ..... 292/247, 87, 88, 113, 292/DIG. 49, 258, 1

[56] References Cited

U.S. PATENT DOCUMENTS

| | | | |
|---|---|---|---|
| 2,074,475 | 3/1937 | Jesser | 292/258 |
| 2,714,032 | 7/1955 | Summers | 292/247 |
| 2,867,863 | 1/1959 | Webb | 292/247 X |
| 2,918,318 | 12/1959 | Sacharski | 292/87 |
| 3,152,823 | 10/1964 | Batterson | 292/87 |
| 3,193,314 | 7/1965 | Johnson | 292/113 |
| 3,831,224 | 8/1974 | MacMaster et al. | 292/113 |
| 3,998,481 | 12/1976 | Anthone | 292/113 |

FOREIGN PATENT DOCUMENTS

| | | | |
|---|---|---|---|
| 77315 | 8/1950 | Norway | 292/247 |

*Primary Examiner*—Richard E. Moore

*Attorney, Agent, or Firm*—Kane, Dalsimer, Kane, Sullivan & Kurucz

[57] ABSTRACT

A safety catch for a toggle latch of the type for fastening two members and including a base adapted to be coupled to one member. A draw bar is connected to the base with a free end for engagement with the other member. The lever is connected to the draw bar and the base and is shiftable to shift the draw bar between open and closed positions and unfasten and fasten the two members respectively. The safety catch includes a first resilient part having a configuration permitting it to be snapped onto a portion of the base. A second resilient part extends from the first part and is adapted to engage with one of the lever and draw bar to lock the lever and draw bar in position with respect to the base and prevent opening of the latch. The second part is resiliently shiftable away from engagement with the one of the lever and draw bar to permit opening of the latch. The toggle latch is designed with a slidable adjustment arrangement to accommodate dimensional variations.

6 Claims, 7 Drawing Figures

ADJUSTABLE TOGGLE LATCH AND SAFETY CATCH

BACKGROUND OF THE INVENTION

There are a variety of different types of toggle latches presently on the market and some designs recognize the need for a safety catch to prevent accidental opening of the latch. This feature is particularly useful in heavy duty areas such as where the latch is used to retain large containers and when the containers are roughly handled.

A common way to maintain the latch in the closed position so that the conventional lever is not accidentally displaced causing the latch to open is to use a wire to attach the opening lever of the toggle assembly to the fixed portion and maintain a positive lock condition. When the lock is to be opened, the wire must be unwound or cut. Unwinding of the wire can be a time consuming procedure both in opening and refastening of the latch. Similarly, if the latch is to be refastened, the cut wire can naturally not be reattached and a new wire has to be used if one is available.

Accordingly, there is a need for a quick and efficient safety catch for a toggle latch which can be used repeatedly and which is inexpensive to manufacture and can be assembled to existing toggle latches or builting to newly formed latches. Ease of operation and cost are important factors, particularly when dealing with a mass produced inexpensive item such as a toggle latch. Examples of several types of toggle latches are in U.S. Pat. Nos. 1,090,634 and 3,127,205. An example of a toggle latch with a safety catch is present in U.S. Pat. No. 3,519,298, and from that reference, it is clear that the need for a positive lock for a toggle type of latch is desirable and necessary. Accordingly, improvements in this area would be extremely valuable and desirable in the field of manufacturing and use of toggle type latches.

Also various types of adjustable toggle latches are available to accommodate dimensional differences and facilitate the latching action. An improved adjustment arrangement on the toggle latch would be desirable.

SUMMARY OF THE INVENTION

With the above background in mind, it is among the primary objectives of the present invention to provide an improved safety catch, inexpensively manufactured, which can be quickly and efficiently mounted to a conventional type of toggle latch to act as a safety catch for the toggle latch and retain it in the locked position. The safety catch is designed so that it can be easily shiftable to the unlocked position permitting opening of the toggle latch. The safety catch can be used repeatedly to again lock the toggle latch in position when the latch is reclosed. The safety catch of the present invention is designed to be integrally formed as part of a toggle latch or mounted to a conventional toggle latch in an easy and efficient manner. The safety catch is formed of a single piece of inexpensive spring material so that part of it snaps into position on the fixed portion of a conventional toggle latch and a second part of the spring safety catch acts as a resilient stop which when in relaxed position holds the lever portion of the toggle latch in locked position and when resiliently displaced releases the lever for opening of the latch.

It is contemplated that the spring catch of the present invention be formed of a resilient and inexpensive spring steel material and have a plurality of arcuate portions between its free ends so that it can resiliently grasp a fixed portion of the toggle latch and extend as a resilient arm to engage and disengage with a movable portion of a toggle latch.

One type of toggle latch to which the present safety catch is particularly adaptable for use is a unique latch of the invention employing a fixed base with a slidable member on the base for adjustment of the latch when it is in fixed position through the use of an adjustment screw. The latch is one which employs a draw bar pivotally mounted to a lever which in turn is pivotally mounted to the slidable member. A further projecting part of the slidable member form surfaces for mounting of the safety catch with the lever extending into overlying position with respect to the further projection. Accordingly, the part of the safety catch extending from the base can then engage with surfaces on the lever portion of the toggle latch either at the end of the lever or through an aperture in the lever to engage with the upper surface thereof.

The draw bar is adapted to be extended into engagement with a keeper on the other member to be fastened. Then when the lever is closed into overlying relationship with the base the draw bar is brought into tight locking engagement with the keeper on the other member with the base of the toggle latch being mounted on one member so that the members are fastened together. Thereafter, when the spring catch is released and the lever is lifted, the draw bar can be removed from the keeper freeing the two members from locked interengagement.

In summary, a safety latch is provided for use with a toggle latch of the type for fastening two members. The toggle latch would include a base adapted to be coupled to one member and a draw bar connected to the base with a free end to engage with the other member. A lever is connected to the draw bar in the base and is shiftable to shift the draw bar between an open and a closed position and unfasten and fasten the two members respectively. The safety catch includes a first resilient part having a configuration permitting it to be snapped onto a portion of the base. The catch also includes a second resilient part extending from the first part and adapted to engage with one of the lever and draw bar to lock the lever and draw bar in position with respect to the base and prevent opening of the latch. The second part of the latch is resiliently shiftable away from engagement with the one of the lever and draw bar to permit opening of the latch. The toggle latch is designed with a unique slidable adjustment arrangement to accommodate dimensional variations.

With the above objectives among others in mind, reference is made to the attached drawings.

DETAILED DESCRIPTION

Figure 1:
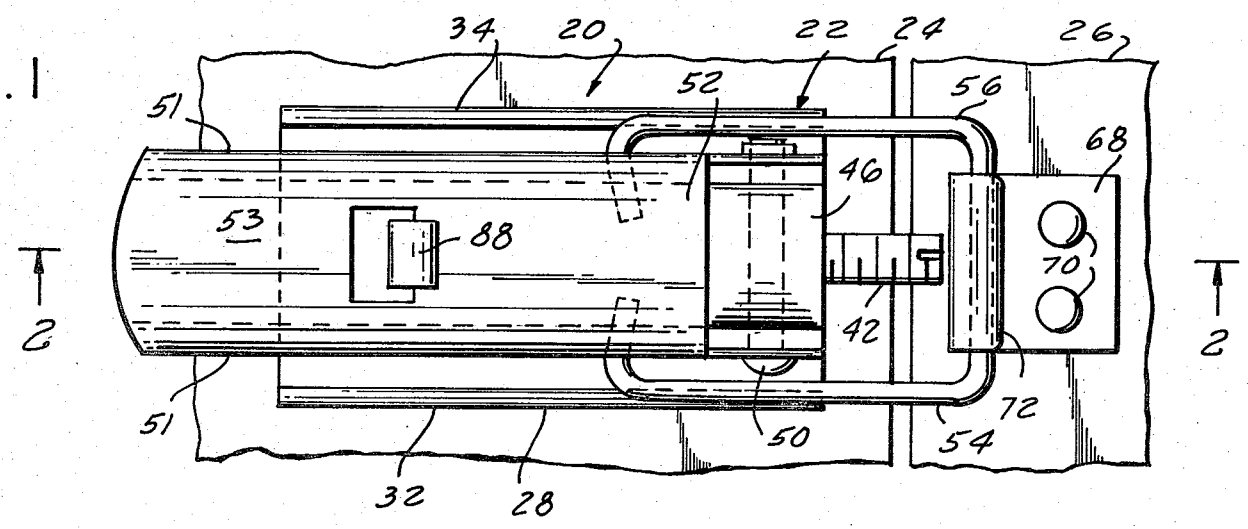
FIG. 1 is a top plan view of the safety catch of the invention mounted to a toggle latch which in turn is mounted to members to be fastened.

Safety catch 20 is depicted in the drawings mounted to a toggle latch 22. The toggle latch is in position to fasten members 24 and 26 together.

The latch includes a fixed base portion 28 which is mounted to member 24 by conventional means such as rivets 30. Extending from the two longitudinal edges on the exposed side of the base are a pair of arcuate channels 32 and 34 which forms a slide way for a slidable member 36 which is slidably mounted therein. The slidable member 36 is restricted in movement in one direction by engagement with an upstanding end wall 38 on the fixed base. A threaded aperture 40 is in the end wall and a threaded adjustment screw 42 extends through aperture 40 and is riveted at its end to an end wall 44 of an upright projection 46 on slidable member 36. A second upright projection 48 is spaced from the first projection 46 and also extends upward from the base of member 36. Both projections 46 and 48 are rectangular in configuration having flat upper surfaces and opposing side walls above the portion of member 36 channeled in channels 32 and 34 of the base. Projections 46 and 48 are hollow and a pivot pin 50 extends through projection 46 and through aligned apertures in the end of lever 52 to form a pivot for the lever 52. A substantially U-shaped draw bar 54 extends with its free ends through apertures in the side walls of lever 52 and has its closed end 56 in position for forming the movable engaging portion of the latch. The free ends 58 and 60 of the U-shaped draw bar extend through receiving holes 62 and 64 in the downwardly extending side flap portions 51 of lever 52. Intermediate the ends of the upper surface 53 of lever 52 is an aperture 66 for use with safety catch 20.

For engagement with draw bar 54, a keeper 68 is mounted to member 26 in a conventional manner such as by rivet 70. An arcuate hook 72 extends from one end of keeper 68 for engagement with the closed end 56 of draw bar 54.

The upper surface 74 of projection 48 forms a flat receiving surface for one part of safety catch 20. The safety catch is formed of one piece of resilient spring material such as spring steel and is bent into the desired configuration. Spaced a short distance from one free end 76 is an arcuate recess 78. The other side of the arcuate recess 78 extends into a flat horizontal portion 80. At the other end of the flat horizontal portion 80 is a second arcuate recess 82. The other end of the arcuate recess 82 connects with a loop portion 84. The loop portion 84 extends into a vertical upright portion 86 which in turn terminates in a downwardly extending bent end 88 with a tab 90 at the other free end of safety catch 20.

Figure 2:
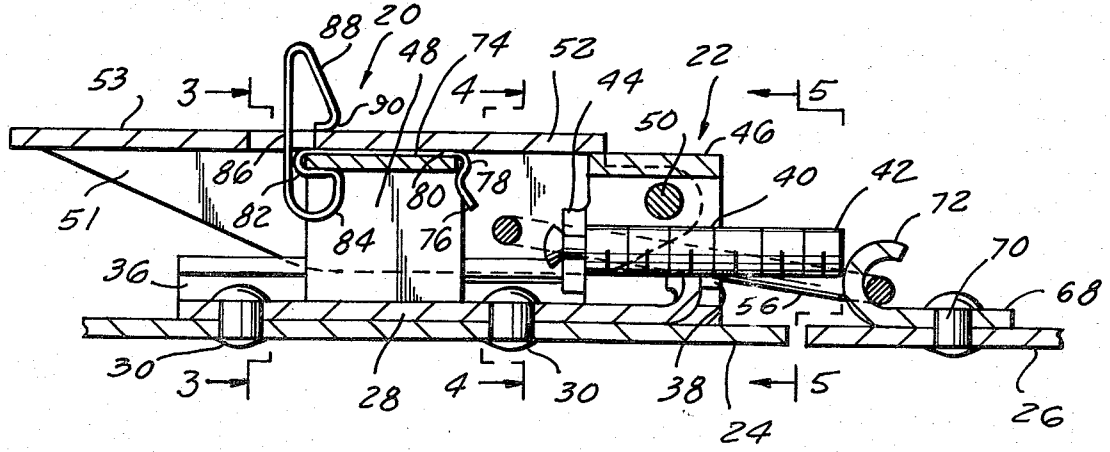
FIG. 2 is a sectional side elevation view thereof taken along the plane of line 2—2 of FIG. 1.
Figure 3:
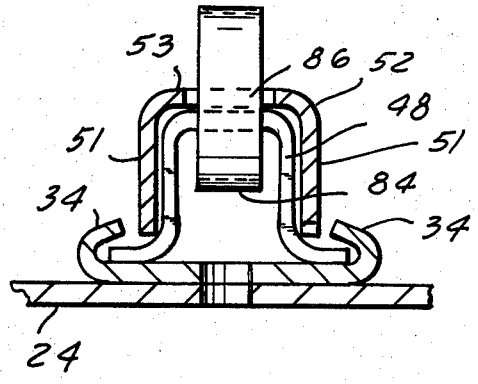
FIG. 3 is a sectional end elevation view thereof taken along the plane of line 3—3 of FIG. 2.
Figure 4:
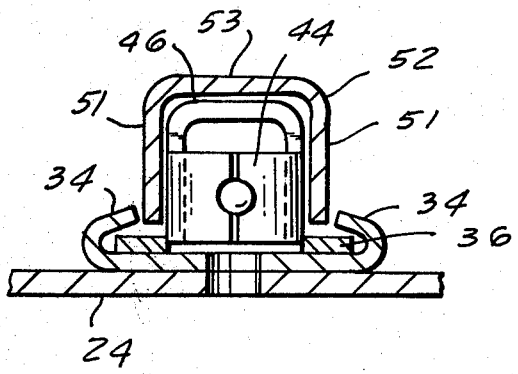
FIG. 4 is a sectional end view thereof taken along the plane of line 4—4 of FIG. 2.
Figure 5:
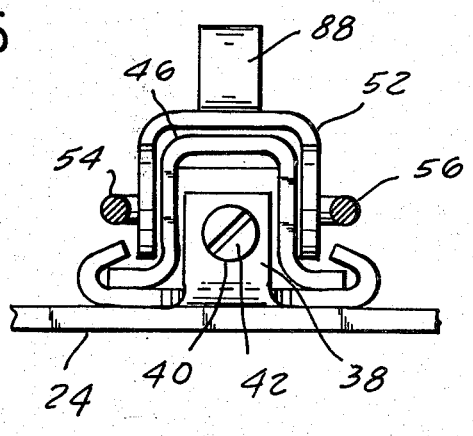
FIG. 5 is a sectional end view thereof taken along the plane of line 5—5 of FIG. 2.

Flat portion 74 and the recesses 82 and 78 at the end of the flat portion form a resilient clip for engagement with the upper surface 74 of projection 48. The recesses extend around the ends of upper surface 74 and onto a portion of the undersurface thus capturing the upper surface of the projection 48 and positioning the safety catch on slidable member 36 mounted on base 28. Upright portion 86 is then in position to extend through aperture 66 in lever 52 whereupon the tab 90 on bent end 88 will overlie and engage the upper surface of the lever adjacent to aperture 66. The lever in the closed position as shown in FIG. 2 extends into overlying position with respect to projection 48 and accordingly in overlying position with the portion of the spring clip mounted on projection 48. Projection 48 is open at both ends to permit access of the spring clip to the undersurface of the flat top side of the projection. In assembly, mounting of the spring clip is accomplished in a quick and easy manner such as by fitting one side of projection 48 into recess 82 and then snapping recess portion 78 around the other side of projection 48 to resiliently form a snug fit to hold the clip in position. To release the lever, bent portion 88 including 90 is deflected toward upright portion 86 until it is in alignment with aperture 66. At that point, lever 52 can be raised which directs draw bar forward and out of engagement with arcuate hook 72 on keeper 68.

For alignment purposes to accommodate dimensional differences in a longitudinal direction, adjustment screw 42 can be rotated either clockwise or counter clockwise and direct the slidable member 66 and connected structure in a corresponding longitudinal direction. In addition to accommodating dimensional differences between the draw bar and the keeper, the adjustment feature also accommodates dimensional differences wth respect to the safety catch and the aperture of the lever and engaging surfaces thereon. The movement is possible since threaded screw 42 is mounted to projection 46 which in turn is mounted to the remainder of movable member 36 and projection 48 on which spring clip 20 is mounted.

Alternatively, the safety catch 20 can be integrally formed as part of the toggle latch. For instance, it can be formed as part of projection 48. Also, the lever can be shortened in which case the aperture would not be necessary. The safety catch would engage with the rear edge of the lever.

After the safety catch 20 has been mounted to projection 48 as described above, and the appropriate adjustments are made for slidable member 36 by means of screw 42, draw bar 54 is positioned in keeper 68 and lever 52 depressed downward to close the latch. When fully depressed, the resilient bent portion 88 of the safety catch will first deflect inwardly as it passes through aperture 66 and, when fully through and released, will resiliently deform back to the initial configuration into overlying relationship with the upper surface of the lever. In this position, tab 90 engages with the upper surface of the lever and holds the lever in the latched or closed position. This is the arrangement depicted in FIGS. 1–5 of the drawings. In this position, the draw bar is in tight interengagement with the keeper and members 24 and 26 are held in tight fastened relationship.

Figure 6:
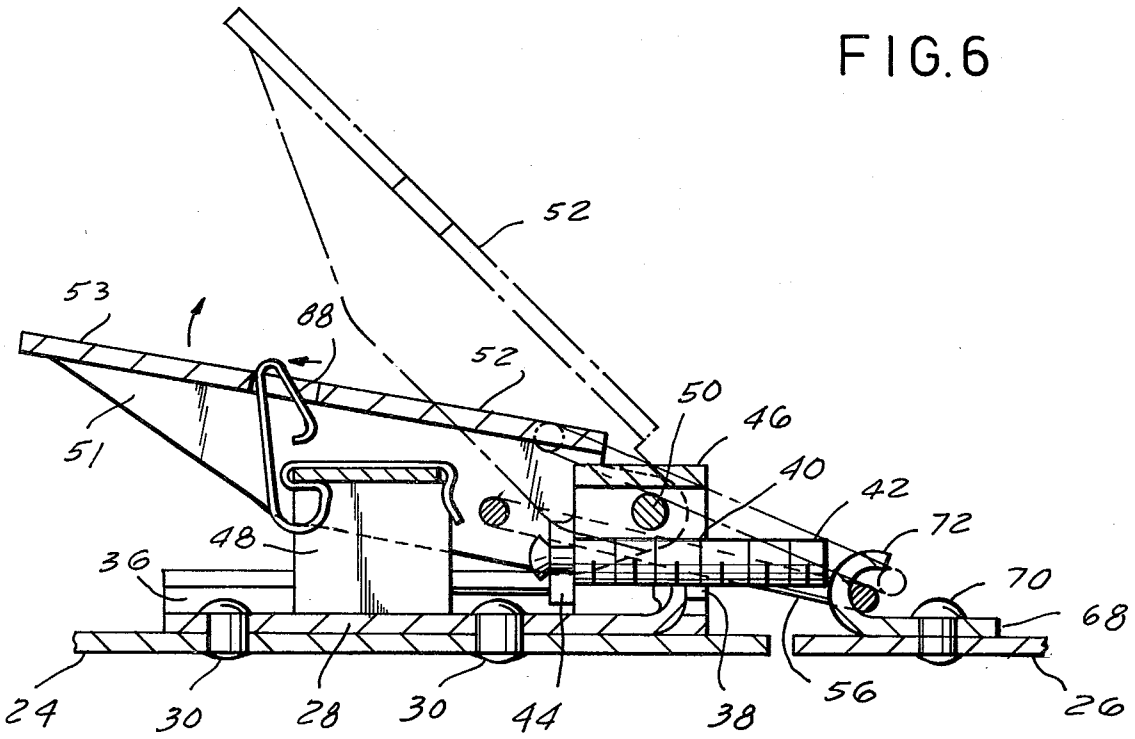
FIG. 6 is a sectional side elevation view thereof showing the toggle latch in partially open condition and in phantom in a further open position.

To open the toggle latch, bent portion 88 is depressed causing the bent portion including tab 90 to be deflected toward opening 66 until in alignment therewith whereupon the lever is free to extend upward toward the opened position. This condition is depicted in FIG. 6. A further movement of the free lever arm 52, as depicted in phantom in FIG. 6, will direct draw bar out of hook 72 of keeper 68. This frees the draw bar to permit the full unlatching action.

Figure 7:
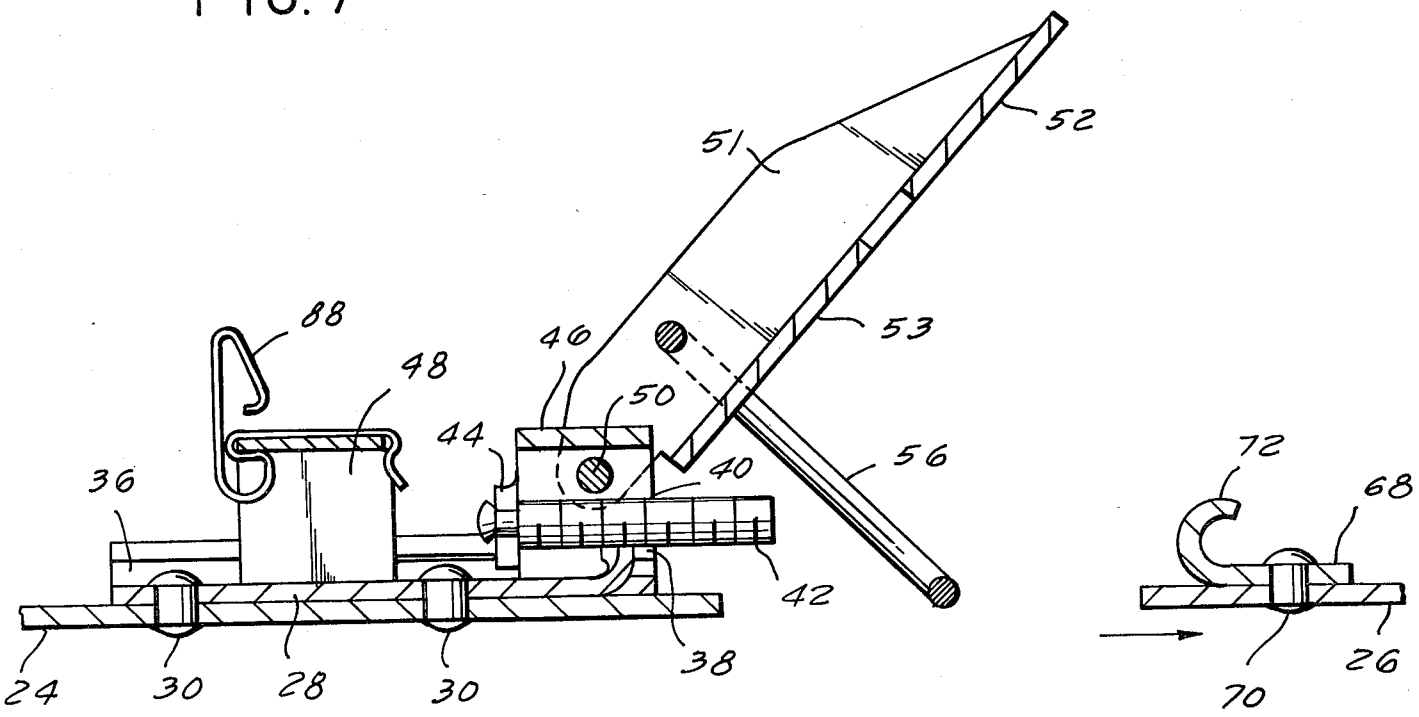
FIG. 7 is a sectional side elevation view thereof showing the toggle latch in fully opened position and the two members separated.

In the full unlatched position as depicted in FIG. 7, the lever arm has been pivoted further and the draw bar 54 removed from keeper 68. Member 26 can be separated from member 24.

In reclosing the toggle latch, the sequence of steps is reversed with the lever arm directed in the opposite direction with draw bar 54 inserted into keeper 68. The lever will extend downward until bent portion 88 is depressed inward again permitting its passage through opening 66. With the lever fully down in the closed position and adjacent to the upper surface of projections 46 and 48, resilient bent portion 88 will snap back to the initial configuration and tab 90 will engage again with the upper surface of the lever to lock the toggle latch in the closed position.

The toggle latch of the invention is designed for use independent of the safety catch with use of the unique adjustment means. Similarly the safety catch can be used with conventional toggle latches as well as the unique one depicted and described herein.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. For use with a toggle latch for fastening two members together, the improvement comprising a safety catch including a first resilient part adapted to be snapped onto the toggle latch, a second resilient part on the safety catch extending from the first part and adapted to engage with a further portion of the toggle latch to lock the toggle latch in closed position fastening the two members together, and the second part being resiliently shiftable with respect to the first resilient part to be biased as the toggle latch is shifted to the closed position and then to automatically snap into position locking the toggle latch to prevent opening of the latch and resiliently shiftable away from engagement with the further part of the toggle latch to permit opening of the latch, the safety catch being formed of a single piece of resilient spring material, the first resilient part including a base having an under side and an upper side and spaced from one end of the safety catch, and the end portion between the base and the one end of the first part being at least partially bent inward to form a first inwardly extending leg with respect to the under side of the base and forming a first recess therebetween, the base terminating in a second inward bend to form a second inwardly extending leg opposed to the first inwardly extending leg and forming a second recess on the under side of the base whereupon resilient outward displacement of the two legs will permit insertion of a portion of a toggle latch into the two recesses and release of the resilient legs will cause the legs to snap into position capturing the portion of the toggle latch between the legs and the under side of the base thus providing for releasable mounting of the safety catch to a toggle latch, a curved loop portion extending from the end of the second leg distal from the base and from the under side of the base to terminate in a connecting leg extending substantially perpendicular to the base from the underside thereof to the upper side thereof, the connecting leg terminating in a bent end overlying the upper surface of the base and spaced upwardly therefrom and the bent end terminating in a tab at the other end of the safety catch, the interconnected tab, bent end, connecting leg and curved loop together forming the second resilient part of the safety catch with the tab adapted to engage with a further portion of a toggle latch, the bent end and tab being displaceable to free the further portion of the toggle latch from engagement with the tab upon the exertion of sufficient pressure to displace the bent end and free the further portion of the toggle latch, and release of the bent end will permit return of the bent end and tab to the relaxed position in overlying engagement with respect to the base and the further portion of the toggle latch to again retain it in position when it is returned to the closed position.

2. A toggle latch used for fastening two members together comprising; a base adapted to be coupled to one member to be fastened, a draw bar connected to the base and having a free end to engage with the other member to be fastened, a lever connected to the draw bar and the base and shiftable to shift the draw bar between open and closed positions and unfasten and fasten the two members respectively, a safety catch including a first resilient part adapted to be removably snapped onto a portion of the base of the toggle latch, the safety catch including a second resilient part extending from the first part and adapted to engage with one of a lever and draw bar to lock the lever and draw bar in position with respect to the base to prevent opening of the latch, and the second part being shaped to be resiliently shiftable with respect to the first resilient part to be biased as the lever and draw bar are shifted to the closed position and then to automatically snap into position locking the lever and draw bar in position to prevent opening of the lock and resiliently shiftable away from engagement with the one of the lever and draw bar to permit opening of the latch.

3. A toggle latch for fastening two members together comprising a base adapted to be coupled to one member to be fastened, a draw bar connected to the base and having a free end to engage with the other member to be fastened, a lever connected to the draw bar and the base and shiftable to shift the draw bar between open and closed positions and unfasten and fasten the two members respectively, adjustment means for permitting a change in location of the draw bar and lever with respect to the base to accommodate for dimensional variation between the members being fastened and facilitating shifting of the latch between the open and closed positions, the adjustment means including a reciprocally slidable member captured by the fixed portion of the base and having at least one projection extending away from the base, and the lever and draw bar being pivotally mounted to said at least one projection, a safety catch is removably mounted on the toggle latch, the safety catch including a first resilient part having a configuration permitting it to be snapped onto a portion of the base of the toggle latch, a second resilient part extending from the first part and adapted to engage with one of the lever and draw bar to lock the lever and draw bar in position with respect to the base to prevent opening of the latch, and the second part being resiliently shiftable away from engagement with the one of the lever and draw bar to permit opening of the latch.

4. The invention in accordance with claim 3 wherein a screw is mounted in threaded engagement with a portion of the fixed base and is attached to the reciprocally slidable member so that rotation of the screw directs the slidable member along the base.

5. The invention in accordance with claim 3 wherein there are two spaced apart projections on the slidable member, the lever being pivotally mounted to one of said projections and when in the closed position overlying the other of said projections.

6. The invention in accordance with claim 3 wherein a safety catch is removably mounted on the toggle latch, the safety catch including a first resilient part having a configuration permitting it to be snapped onto a portion of the base of the toggle latch, a second resilient part extending from the first part and adapted to engage with one of the lever and draw bar to lock the lever and draw bar in position with respect to the base to prevent opening of the latch, and the second part being resiliently shiftable away from engagement with the one of the lever and draw bar to permit opening of the latch.

* * * * *